US009188289B2

(12) United States Patent
Peil et al.

(10) Patent No.: US 9,188,289 B2
(45) Date of Patent: Nov. 17, 2015

(54) LED LAMP FOR HOMOGENEOUSLY ILLUMINATING HOLLOW BODIES

(75) Inventors: Michael Peil, Otzberg (DE); Florin Oswald, Frankfurt (DE); Harald Maiweg, Korschenbroich (DE)

(73) Assignee: Heraeus Noblelight GmbH, Hanau (DE)

( * ) Notice: Subject to any disclaimer, the term of this patent is extended or adjusted under 35 U.S.C. 154(b) by 59 days.

(21) Appl. No.: 13/637,661

(22) PCT Filed: Mar. 25, 2011

(86) PCT No.: PCT/EP2011/001510

§ 371 (c)(1),
(2), (4) Date: Sep. 27, 2012

(87) PCT Pub. No.: WO2011/124331

PCT Pub. Date: Oct. 13, 2011

(65) Prior Publication Data

US 2013/0010460 A1 Jan. 10, 2013

(30) Foreign Application Priority Data

Mar. 29, 2010 (DE) ..... 10 2010 013 286

(51) Int. Cl.

| | |
|---|---|
| ***F21V 21/00*** | (2006.01) |
| ***F21S 4/00*** | (2006.01) |
| ***F21K 99/00*** | (2010.01) |
| *F21Y 101/02* | (2006.01) |
| *F21Y 111/00* | (2006.01) |

(52) U.S. Cl.

CPC ..... *F21K 9/00* (2013.01); *F21Y 2101/02* (2013.01); *F21Y 2111/005* (2013.01)

(58) Field of Classification Search

CPC .. F21K 9/00; F21Y 2101/02; F21Y 2111/005
See application file for complete search history.

(56) References Cited

U.S. PATENT DOCUMENTS

| | | | | |
|---|---|---|---|---|
| 2003/0235800 | A1* | 12/2003 | Qadar | 433/29 |
| 2005/0024870 | A1 | 2/2005 | Coushaine | |
| 2005/0270791 | A1* | 12/2005 | Lee | 362/517 |
| 2007/0257272 | A1* | 11/2007 | Hutchins | 257/98 |

(Continued)

FOREIGN PATENT DOCUMENTS

| | | | |
|---|---|---|---|
| DE | 102007038196 | A1 | 2/2009 |
| DE | 102007038197 | A1 | 2/2009 |

(Continued)

OTHER PUBLICATIONS

Int'l Preliminary Report on Patentability issued Oct. 11, 2012 in Int'l Application No. PCT/EP2011/001510.

(Continued)

*Primary Examiner* — Donald Raleigh
(74) *Attorney, Agent, or Firm* — Panitch Schwarze Belisario & Nadel LLP

(57) ABSTRACT

A lighting device is provided for the uniform illumination of curved, uneven, or polyhedral surfaces. The lighting device has a plurality of flat chip-on-board LED modules, which are arranged adjacent to each other at least in pairs. Each chip-on-board LED module has a plurality of light-emitting LEDs. The lighting device is characterized by at least one pair of the adjacent chip-on-board LED modules being arranged at an angle greater than 0° with respect to the surface normals of the modules.

20 Claims, 5 Drawing Sheets

(56) References Cited

U.S. PATENT DOCUMENTS

| | | | | |
|---|---|---|---|---|
| 2009/0016072 | A1 | 1/2009 | Lee et al. | |
| 2010/0001664 | A1 * | 1/2010 | Shih | 315/313 |
| 2010/0051168 | A1 | 3/2010 | Moeskjaer et al. | |
| 2011/0140136 | A1 * | 6/2011 | Daily et al. | 257/89 |

FOREIGN PATENT DOCUMENTS

| | | | |
|---|---|---|---|
| DE | 102008010167 | A1 | 8/2009 |
| EP | 1357331 | A2 | 10/2003 |
| EP | 1959183 | A1 | 8/2008 |
| EP | 2151617 | A1 | 2/2010 |
| JP | 2003-168305 | A | 6/2003 |
| JP | 2007-059930 | A | 3/2007 |
| JP | 2008-142996 | A | 6/2008 |
| JP | 2008-175381 | A | 7/2008 |
| JP | 2008-265245 | A | 11/2008 |
| JP | 2008-277174 | A | 11/2008 |
| JP | 2009-277586 | A | 11/2009 |
| JP | 2010-055993 | A | 3/2010 |
| KR | 20-2009-0006121 | U | 6/2009 |
| WO | 2008135927 | A1 | 11/2008 |
| WO | 2010009491 | A1 | 1/2010 |

OTHER PUBLICATIONS

Office Action issued Jan. 18, 2011 in DE Application No. 10 2010 013 286.1.

Int'l Search Report issued Aug. 2, 2011 in Int'l Application No. PCT/EP2011/001510.

German translation of an Office Action issued Oct. 28, 2013 in JP Application No. 2013-501676.

English translation of an Office Action issued Oct. 10, 2013 in KR Application No. 10-2012-7025811.

* cited by examiner

Fig. 8
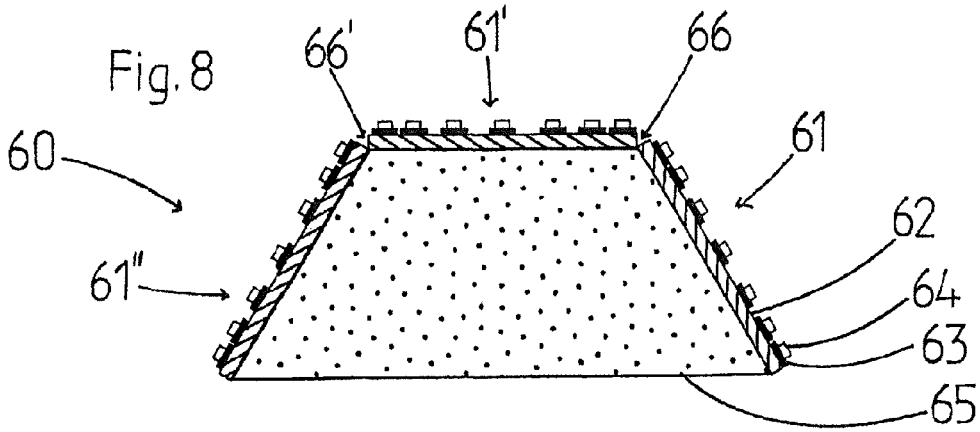
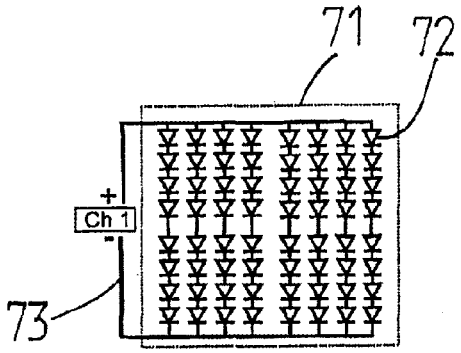
Fig. 9a)
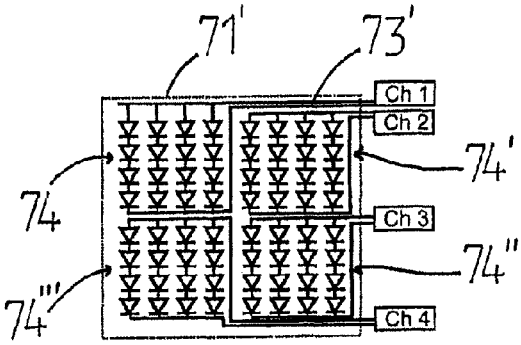
Fig. 9b)
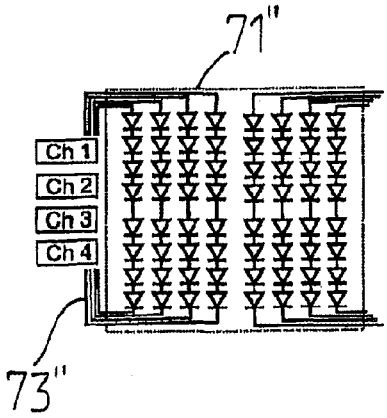
Fig. 9c)
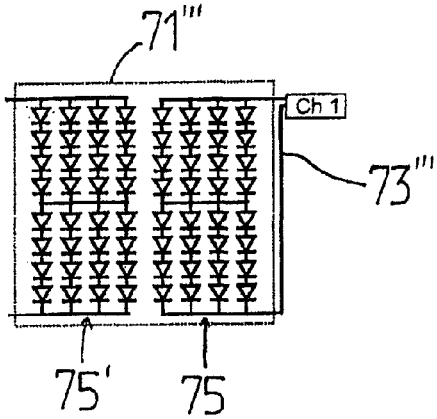
Fig. 9d)

LED LAMP FOR HOMOGENEOUSLY ILLUMINATING HOLLOW BODIES

CROSS-REFERENCE TO RELATED APPLICATIONS

This application is a Section 371 of International Application No. PCT/EP2011/001510, filed Mar. 25, 2011, which was published in the German language on Oct. 13, 2011, under International Publication No. WO 2011/124331 A1 and the disclosure of which is incorporated herein by reference.

BACKGROUND OF THE INVENTION

The invention relates to a lighting device for the uniform illumination of curved, uneven, or polyhedral surfaces, comprising a plurality of flat chip-on-board LED modules, which are arranged adjacent to each other at least in pairs, wherein each chip-on-board LED module has a plurality of light-emitting LEDs. The invention further relates to an lighting unit and a use.

One field of application that requires a uniform illumination of curved, polyhedral, or uneven surfaces is the curing and light exposure needed for drying, hardening, or exposure of lacquers, adhesives, resins, and other light-reactive materials, with which the insides or outsides of uneven bodies are coated.

One example here is duct relining, where it is known to provide the inside of pipes with a light-curable coating or substance in the form of a hose. For curing a so-called "pipe liner," a resin-saturated glass-fiber fabric having protective plastic films on the outer surfaces, a lamp is forced through the hose or through the pipe for the duct relining, in order to progressively dry and cure the coating material section by section by an intensive illumination. Suitable lamp systems ideally have a curved shape for bends up to 90°. Typical diameters of corresponding coated pipes and hoses are in the range of a few centimeters up to several meters.

This procedure requires a uniform exposure to light, in order to achieve a uniform drying and curing of the coating material on all sides. Typical homogeneity tolerances for the illumination lie in the range of less than +15% with respect to a defined average. For this application, the illumination intensities on an illuminated inner wall are a few $\mu W/cm^2$ up to 100 $W/cm^2$.

In order to achieve a high light power, corresponding known lamp systems are provided with a diameter that is only a few millimeters less than the inner diameter of the pipe that they are designed for. However, the lamp could also be located up to a few meters from the surface to be illuminated.

Similar requirements are known for the interior illumination of other radially symmetric, convex hollow bodies. This applies, for example, in the field of lighting equipment, e.g., for architectural lighting, for UV curing, and for the exposure to light of elongated bodies or hollow spaces having specified cross-sectional geometries. Suitable geometries are, for example, pipes, cones, spheres, polyhedral bodies, or the like.

For the application example of the light-curing duct relining, gas-discharge lamps until now have usually been used that provide an intensive light output. The traditionally used gas-discharge-based lamps develop strong heat emissions or infrared emissions that heat up the object and the coating to be cured if the lamp comes too close to the object to be illuminated or if the illumination lasts too long. For UV curing processes, this means that the polymers to be cross-linked can disassociate. In duct relining, this can result in thermal damage in the liner material to be cured.

The known lamps are suitable, above all, for larger pipe diameters, but due to their overall size are less suitable for smaller pipe diameters, for example in building connections, having typical pipe diameters corresponding to a nominal diameter of 160 mm or smaller. There are no gas-discharge lamp systems of this size available, that can be pulled through curves having angles of 45° or 90°.

For small overall sizes, the traditional UV lamp technology is limited by the achievable minimum size of the lamps. Another limitation in this respect is also due to the requirement for a mechanically robust holder and protective device for the lamps, which usually consist of a glass enveloping body filled with a substance, in which the gas discharge takes place between two opposing electrodes or by an electrodeless excitation with microwaves. With a suitably mechanically robust holder or protective device, for example in the form of metal rods surrounding the lamp, shadows in the emitted radiation must be reckoned with. These inhomogeneities in the emissions are disadvantageous, if a uniform irradiation is required, for example in UV curing.

In particular, the use of several traditional glass bulb lamps for achieving high irradiation intensities makes it more difficult to achieve a homogeneous illumination due to the significant geometric expansion of these lamps, when these are arranged one next to the other in the peripheral direction, for example of a pipe. This results from the fact that a good overflow of the emitted radiation fields takes place only at a geometric spacing corresponding to the spacing of the emission centers, so that drops in the radiation intensity due to the lack of emissions between the emission centers of the lamps lead to strong inhomogeneities in the peripheral direction. In this case, possibly expensive optics must be used for the homogenization of the illumination.

BRIEF SUMMARY OF THE INVENTION

The present invention is therefore based on the object of providing a lighting device for the uniform illumination of curved, uneven, or polyhedral surfaces, which can be used for compact hollow bodies or bodies of typical inner diameters or outer diameters in the range of a few millimeters up to several meters and allow irradiation intensities on the illuminated inner or outer wall in the range of a few 10 $\mu W/cm^2$ up to 100 $W/cm^2$. The lighting device should be usable particularly for duct relining.

This object is achieved by a lighting device for the uniform illumination of curved, uneven, or polyhedral surfaces, comprising a plurality of flat chip-on-board LED modules, which are arranged adjacent to each other at least in pairs, wherein each chip-on-board LED module has a plurality of light-emitting LEDs and is further refined in that at least one pair of adjacent chip-on-board LED modules is arranged with respect to the surface normals of the modules at an angle greater than 0°.

The invention involves the use of LEDs, that is light-emitting diodes, which are processed using a Chip-on-Board mounting technology, also abbreviated as "COB." In the scope of the present invention, a chip-on-board LED module is understood to be a unit that comprises a flat substrate and un-housed LED chips applied to this substrate using COB technology, as well as optionally corresponding strip conductors. Here, one or more un-housed LED chips are mounted on a suitable substrate having a typical edge length of a few 100 μm up to a few millimeters, which offers good options for comprehensively fulfilling the described object.

COB technology is a flexible mounting technology, which allows the use of a wide range of construction and connection materials. In the field of substrate technology, highly thermal conductive materials, as for example metal core conductor plates, metal, ceramic, and silicon substrates can be used, in order to build powerful LED lamps, but also cost-effective FR4 conductor plates or substrates required for certain special applications, e.g., glass or plastic substrates. Therefore, COB technology offers a large range of play for optimizing costs and performance.

In comparison to SMT technology, that is "Surface Mounted Technology," which can be used with lower technical expense, in which one or typically up to four LED chips in an individual housing are applied on a conductor plate, as a rule by soldering, the Chip-on-Board technology, which is more expensive from a production viewpoint, also offers advantages for the stated task.

The smallness of the un-housed LED chips and the greater flexibility of the possible arrangement of the chips on the substrate allow a good adaptation to the geometry of the curved, polyhedral, uneven surface to be illuminated and, in particular, excellent options for optimizing the lighting device with respect to high homogeneity of the illumination of the surface to be illuminated. The arrangement of the LED chips on the possible substrates can be adapted to the selected task. For this purpose, the known emission properties and powers of the LEDs must be taken into account for achieving the desired emission intensities and homogeneity tolerances.

Through a targeted adaptation of the substrate geometry and the geometric arrangement of the individual substrates, as well as the arrangement of the LEDs on the individual substrates, the requirement for using optics can be avoided or the optics can be simplified. In addition, LEDs are known for their mechanical robustness against vibrations, the possibility to realize long service lives, and the good tunability of the emission wavelength through suitable selection of the LEDs, as well as the Lambert radiation characteristics that are typically and easily used or adjusted for surface emitters.

Due to the smallness of LEDs and the possibility to place these directly or densely next to another using Chip-on-Board technology, the gaps between the illuminating centers can also be so small that a very uniform light output is realized even at a small distance above the LEDs, for example at a distance of only 100 μm, due to a good overlap of the light cones of adjacent LEDs. The light generation by LEDs can also be associated with a very low heat generation. At the same time, through the possibility of dense packing of LEDs, high irradiation intensities of up to several tens of $W/cm^2$ can be realized. The mechanical robustness of the LEDs is also an advantage with respect to breakable and vibration-sensitive gas-discharge and incandescent lamps.

The electrical operating type of the LEDs can be optimized to the application and with respect to the optical output power, wavelength stability, thermal aspects of the LEDs, structures, and the service life of the LEDs. For this purpose, LEDs can be operated, for example, continuously, in pulse-width modulation, or in a constant charge technique, wherein the parameters available, for example, operating current, pulse duration, pulse pattern, pulse amplitude, can be adapted to and optimized for the application.

Very compact, powerful lighting devices having small diameters in the range of a few millimeters up to a few meters can be realized, so that small and large bodies can be strongly illuminated. In the case of the specific application, this means that it is possible to realize a powerful, bendable lamp for relining pipes having inner or nominal diameters even from 80 mm to 300 mm in the field of building connections. In addition, in this field, the use of the technology for larger pipe diameters is also possible, because the system allows high outputs and the geometric size can be scaled up.

LEDs can be realized in the spectral range of 220 nm up to greater than 4500 nm having selected emission wavelengths. Therefore, lighting devices can be realized having precisely defined emission wavelengths. In the field of analytical or industrial applications, the wavelength can be selectively optimized for and adapted to the process. In addition, LEDs of different wavelengths can be used, in order to realize or imitate specified emission spectra as so-called "multi-wavelength lamps."

LEDs emit narrow-band emissions having typical bandwidths of a few tens of nanometers. Therefore, spectral ranges that are sensitive in terms of processing or safety can be avoided, e.g., cell-irritating UV-A, UV-B, and UV-C emissions for light curing in applications using wavelengths of greater than 400 nm, for example pipe liner applications at 430 nm, or infrared radiation in UV curing with LEDs that can damage temperature-sensitive objects made of plastic. This is an advantage relative to medium-pressure and high-pressure gas-discharge lamps that have wide-band spectral emissions. The narrow-band spectral emissions also allow an optimization of the wavelength to the processing window of the wavelength sensitivity. Therefore, the energy efficiency is increased in comparison to wide-band light sources that emit portions of energy in spectral ranges that are undesired or contribute nothing to the desired process.

Because the LEDs used emit no infrared radiation in many cases, the temperature of the device remains in a range of less than 60° C., so that there is no risk of burns for humans.

Additional advantages of LEDs are that they can be operated in demanding environments, optionally with the realization of adapted housing technology for the lamps, for example under high pressures, low-pressure atmospheres, in damp environments, in water, in dusty environments, in vibrating machines, or under high acceleration. They can be switched more quickly than traditional lamps. Their full output power is already reached within microseconds. Therefore, the need to use mechanical shutters is eliminated in applications that are associated with switching processes. In particular, LEDs in the UV spectrum and in the spectrum of visible light are mercury-free and environmentally friendly. Therefore, they can be used in critical environments, e.g., in the food industry and in the drinking water supply. LEDs provide service lives of greater than 10,000 hours and thus exceed most traditional lamps, so that maintenance costs can be reduced.

Because LEDs are usually assembled on flat surfaces or substrates, the chip-on-board LED modules are arranged according to the invention at least partially at an angle relative to each other or at least some adjacent chip-on-board LED modules are arranged at an angle that is greater than 0° with respect to the surface normals of these modules. Here, the geometry that is set should agree as much as possible with the geometry of the surface to be illuminated. From the viewpoint of production, a compromise in terms of the number and dimensions of the chip-on-board LED modules must be found. The illuminating surfaces can also have combinations of curved and flat surfaces in the scope of the invention, or can be non-continuously flat, for example polyhedral surfaces.

For larger, flat partial surfaces, advantageously two or more of the chip-on-board LED modules can be arranged without an angle relative to each other.

In comparison to SMT technology, the COB technology offers the advantage that more LEDs per unit of surface of the substrate can be assembled, in order to make possible the necessary power densities. In addition, the spacing to be maintained for a homogeneous light distribution in SMT technology due to the housing size of a few millimeters is greater, because approximately 75% of the emitted light from a flat LED is emitted in a cone having a 120° opening angle. Only if the light cones of adjacent LEDs overlap sufficiently and the substrate surface equipped with LEDs has a sufficient extent will a uniform irradiation of the surface to be illuminated be achieved. For housed LEDs used in SMT technology having a typical edge length of 5-10 mm, the minimum spacing of adjacent LEDs is likewise approximately 5-10 mm (chip to chip). For a sufficient overlap of the radiation fields of the LEDs and thus a sufficiently high homogeneous light distribution without the use of optics, a sufficiently large spacing of a few to several centimeters from the LEDs to the surfaces to be illuminated is required. The COB technology allows, however, minimum chip spacings of a few tens of micrometers, so that the light cones of adjacent LEDs already overlap well at a comparable spacing, so that no dark spots are produced on the object.

An advantageous embodiment of the lighting device according to the invention consists in that the chip-on-board LED modules produce an elongated lighting device that has an irregular or regular polygonal cross section, at least in some sections along its longitudinal extent, or are arranged into a regular or irregular polyhedral shape, in particular into a Platonic or Archimedean solid. These mentioned geometries of LEDs in COB technology allow the homogeneous illumination and lighting of radially symmetrical convex hollow spaces or bodies while avoiding technically complicated and cost-intensive complex optics. They can be produced in a particularly easy way even with flat substrates and allow a very homogeneous luminosity distribution. Here, the elongated shape having a polygonal cross section is especially suitable for applications in which the inside of a hose or a pipe or the outside of a pipe or hose is provided with a coating to be cured. The polyhedral shape that is not elongated is especially suitable for non-elongated hollow spaces or bodies.

This structural principle can also be used for bodies having low radial symmetry and for not completely radially symmetrical bodies, for example half bodies. Likewise, this can be applied in some cases in which the bodies to be illuminated or lighted are not convex, but instead concave or are predominately convex or concave and have a structure that projects or is set back from the regular body, e.g. the cross-sectional geometry of a half pipe, a star shape, a rectangular milled recess in a square pipe, or the like.

The light source can be adapted to the geometry of the hollow space or body to be illuminated and, if necessary, can almost completely fill up the interior of the hollow body or can be almost completely filled up by the body to be illuminated. This geometric adaptation comprises both the selection of the chip size and geometry, the arrangement of the chips with respect to their position, and the alignment of the chips relative to each other. For example, offset chip arrangements of adjacent rows are provided for shadow-free continuous processing, lattice-like or hexagonal packaging structures, etc. Other adaptation parameters are the size, geometry, and arrangement of the substrates, as well as the geometry of a body on which the substrates are positioned.

If the shape of the lighting device is advantageously flexible, then the lighting device can be adapted to different or varying shapes of the surfaces to be illuminated.

For the illumination of the inside walls of hollow spaces or the outside walls of bodies, it is advantageously provided that the LEDs of the chip-on-board LED modules are arranged pointing outward or into a hollow space of the lighting device.

In one advantageous embodiment, at least two chip-on-board LED modules are connected to a common heat sink that can be connected or is connected, in particular, to a coolant circuit. Thermal dissipation losses are thus led away from the LED chip, because the chip-on-board LED modules are connected to a heat sink. This takes place with the help of a heat conductive paste or by bonding, soldering, or sintering. This heat sink can be used as a lamp body and can take advantage of different cooling mechanisms. Common mechanisms are convection cooling, air cooling, water cooling, and evaporative cooling. The mechanism to be used can be optimized to the application, wherein cost aspects, cooling efficiency, cooling capacity, usability of the supply and cooling media, and the space required for implementing the application are factors in the decision.

Because LEDs have a degree of efficiency of up to a few ten percent and specified limit temperatures must not be exceeded during operation, the higher packaging densities achieved using COB technology require higher cooling powers of the heat sink. Because the cooling power of a heat sink is increased by a larger volume, cross sections that are as large as possible are desired for these cooling bodies. For this reason, the spacing from the inner surface of the hollow body to be illuminated should also be kept small. In this context, densely packed LEDs assembled using COB technology allow a more homogeneous illumination than LEDs assembled using, e.g., SMT technology.

Achieving a homogeneous illumination of uneven surfaces, for example radially symmetric convex bodies, by LEDs assembled on flat substrates is therefore made more difficult because the radiation cones of LEDs on adjacent substrates do indeed overlap, but this should occur on substrate planes that are inclined relative to each other. For example, with an octagon this angle of inclination between the surface normals is 45°, so that an overlap of the light cones of adjacent LEDs at the boundary between two adjacent substrates is smaller than the overlap of the emission cones of adjacent LEDs of one substrate.

In order to maintain a small intensity drop associated with the reduced overlap in the boundary region, it is advantageously provided that the placement of LEDs on a chip-on-board LED module is varied as a function of location, in particular, increases or decreases toward the edge region of the chip-on-board LED module. This variation in density requires no optics to produce a homogenization of the radiation distribution at the edge between two chip-on-board LED modules.

In this context, it is also advantageous if LEDs are arranged on a chip-on-board directly up to an edge of the chip-on-board LED modules, that is, up to the boundary of the substrate. In this way, the gaps between the LED chips on both sides of the boundary are minimized, and the overlap of the emission cones is maximized.

COB technology also advantageously makes it possible to power individual LEDs or groups of LEDs of one chip-on-board LED module separately from each other. In this way it is possible, by a different supply of power to different LED chips, to homogenize the radiation distribution, in which, for example, LED chips at the edges of the chip-on-board LED modules are driven with a higher voltage or a higher current than those in the center of the module. In a series and/or parallel circuit, the groups advantageously consist of a number of LEDs that corresponds to a square number, e.g., 4, 9, 16, 25, 36, 49, 64, etc.

The LEDs of a lighting device can be switched individually or in groups, such that the light sources can be operated with low voltages. This measure provides a high degree of handling safety, especially in damp environments.

It is especially preferred if groups of LEDs of the chip-on-board LED modules that can be supplied with power separately from each other are arranged in rows, half surfaces, or quadrants of the chip-on-board LED modules.

These measures described above for the homogenization of the radiation distribution can be easily realized using COB technology.

For their protection, the LEDs of a chip-on-board LED module are advantageously covered, at least in some sections, by an optically transparent or diffuse material or encased in an optically transparent or diffuse material. The LEDs can be encased for protection from mechanical loads, water, dust, and for electrical and thermal insulation, with a silicon, epoxy, or polyurethane material. In addition, LEDs can be protected by transparent or opaque or diffuse glasses, e.g., borosilicate, float glass, or quartz glass. In the scope of the present invention, a diffuse material is understood to be a milky transparent material. The two protection techniques can be applied both to individual LEDs and also to LED groups.

Preferably, lateral limits for the overlapping material or enclosures for the potting material are optically transparent and/or have a height above a surface of the LEDs that does not exceed a spacing between adjacent LEDs. This measure also ensures that shadows by an enclosure are kept to a minimum, especially at the boundary surfaces. For the application of a damping and filling technique for the potting, a transparent or opaque or diffuse material is used as a dam or frame, in order to improve the overlap of the fields of radiation of the edge LEDs of two substrates.

In one preferred embodiment it is provided that a chip-on-board LED module has at least one imaging and/or non-imaging primary optical element and/or secondary optical element, in particular at least one optical element from the group of reflectors, lenses, and Fresnel lenses.

The lighting device further preferably comprises at least one sensor, in particular at least one sensor from the group of photosensors, temperature sensors, pressure sensors, motion sensors, voltage sensors, current sensors, and magnetic-field sensors, which detect an operating status of the lighting device. Thus, sensors can be placed on the LED substrate or at different points in the lighting device, which sensors report back the operating status of the lighting device. By feedback mechanisms, process-relevant parameters can be actively controlled, e.g. the operating current, the control of certain LEDs or groups, the coolant circuit, the lamp shape, the movement of the lamp or of an illuminated object, the temperature of the object, in order to optimize the process and the result. Likewise, tolerances or degradation processes can be compensated.

The object forming the basis of the invention is also achieved by a lighting unit comprising a control device, a connection line, and at least one lighting device according to the invention as described above, as well as by a use of a lighting device described above for illuminating hollow bodies that are convex at least in sections, in particular for the drying, curing, and/or exposure to light of light-reactive lacquers, adhesives, and resins, in particular a pipe liner.

The lighting device and use according to the invention, for example in the field of duct and pipe relining, offer the advantage of high radiation intensities having high homogeneity of the radiation distribution and at the same time good bendability of small pipes even in 90° bends. Several chip-on-board LED modules can be coupled to each other flexibly and pulled through a pipe, in order to output the necessary dose of radiation for curing a light-reactive coating and at the same time to allow a sufficient pulling speed.

The features and advantages mentioned in connection with the lighting apparatus according to the invention apply analogously also for the lighting arrangement according to the invention and for the use according to the invention and vice versa.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 8 is a schematic cross-sectional diagram through a lighting device according to an embodiment of the invention;

FIGS. 9*a*), *b*), *c*) and *d*) are schematic wiring diagrams of different control possibilities of LEDs in a chip-on-board LED module according to embodiments of the invention;

In the figures, the same or equivalent elements or corresponding parts are provided with the same reference symbols, so that a corresponding repeated explanation is omitted in the following description.

DETAILED DESCRIPTION OF THE INVENTION

Figure 1:
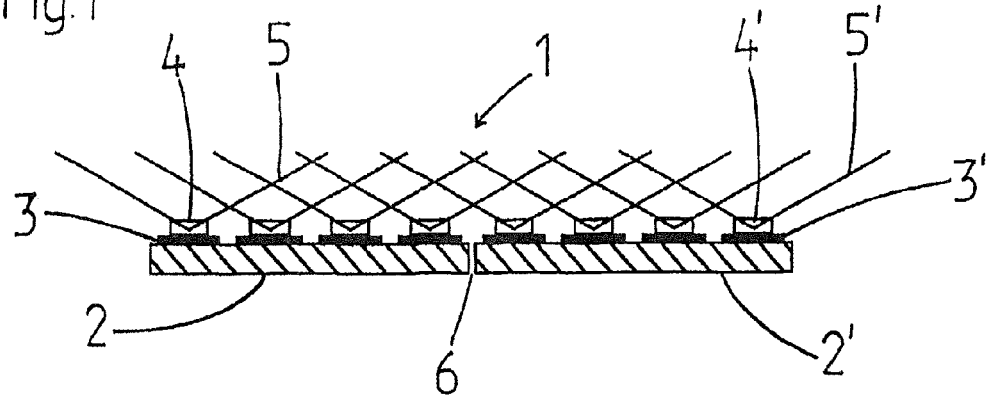
FIG. 1 is a schematic lateral, cross-sectional diagram of a chip-on-board LED module according to an embodiment of the invention.

In FIG. 1 a chip-on-board LED module 1 is shown schematically in cross section, in which strip conductors 3, 3' and LED Chips 4, 4' are arranged at a regular spacing on two substrates 2, 2' arranged in parallel. One substrate 2, 2' can be, for example, a metal core conductor plate, a ceramic substrate, or an FR4 substrate, which can be constructed using a rigid, semi-flexible, or flexible substrate technology. For reasons of clarity, not all of the repeating elements in FIG. 1 are provided with reference symbols, but these symbols refer to all equivalent elements.

The light cones 5, 5' of the LED chips 4, 4' are shown with lines. The LEDs are approximately Lambert radiators, which emit approx. 75% of the total emitted light power within an opening angle of 120°. A good overlap of the emission cones 5, 5' at the boundaries of adjacent LED chips 4, 4' is already given at spacings on the order of magnitude of the chip spacings, also called "pitch," so that no significant intensity modulations are measurable along the row of LED chips 4, 4'. This comes from the fact that the intensity minimums and maximums above the row are averaged out by a good overlap of the emission cones 5, 5' of adjacent LED chips 4, 4' as well as by LED chips of the further surroundings.

If the surface equipped with LED chips 4, 4' is expanded relative to the measurement distance and the spacing is sufficiently greater than the pitch of the LED chips, then a homogeneous intensity distribution is measured having similar properties as those of a homogeneous, diffusely illuminating surface.

Figure 2:
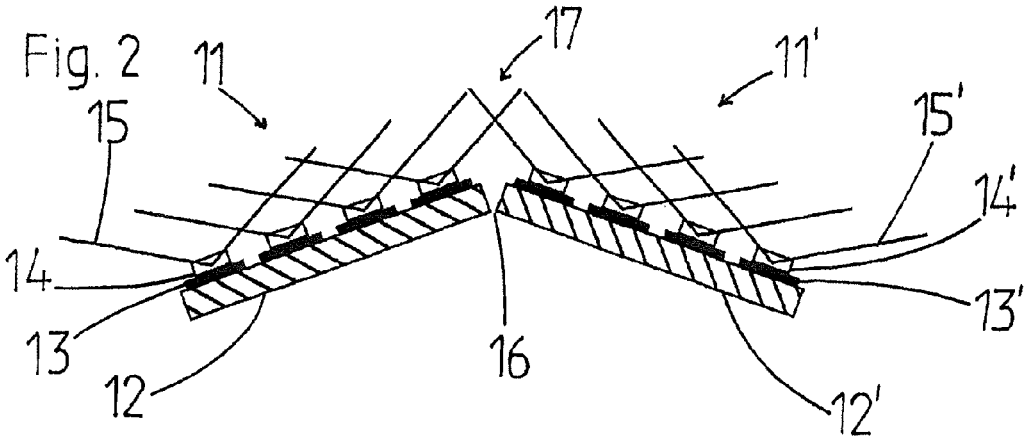
FIG. 2 is a schematic lateral, cross-sectional diagram of two chip-on-board LED modules arranged tilted relative to each other according to an embodiment of the invention.

FIG. 2 shows two chip-on-board LED modules 11, 11' having substrates 12, 12 inclined relative to each other in cross section. Each module has several strip conductors 13, 13' and LED chips 14, 14' having emission cones 15, 15'. They abut each other at a joint 16. It has been shown that a good overlap of the emission cones 15, 15' can be realized at the joint 16, even if the chip-on-board LED modules 11, 11' are inclined relative to each other, because an area 17 with weaker illumination is only very locally limited, even in the area of the joint 16. For the use of COB technology and the realization of a small pitch between the LED Chips 14, 14' and placement of components up to the edge of the substrates 12, 12', good homogeneous light distributions can also be achieved past the abutting edges 16 between two substrates 12, 12'. Likewise, the geometry of the chip-on-board LED modules 11, 11' can be adapted to the geometry of a homogeneously illuminated surface or a surface to be illuminated homogeneously.

Figure 3:
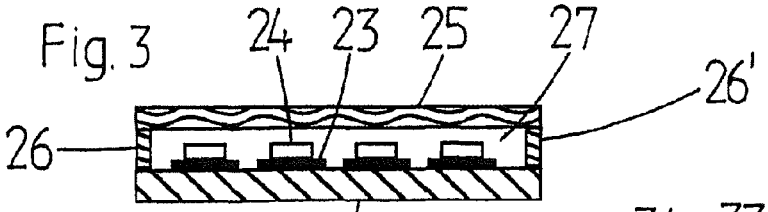
FIG. 3 is a schematic lateral, cross-sectional diagram of an encapsulated chip-on-board LED module according to an embodiment of the invention.

FIG. 3 shows schematically in cross section a chip-on-board LED module 21, in which the LED chips 24 on strip conductors 23 on a substrate 22 are protected by a glass cover 25, represented by wavy lines. This cover offers protection from mechanical damage of the LED chips 24, as well as from corrosion, moisture, contamination, and other interfering factors or factors that are dangerous to the functioning. An intermediate space 27 can contain air, a protective glass, liquids, for example water or an oil, or a gel, for example a silicon gel, and can also be sealed, optionally hermetically, from the surroundings. This enclosure is bounded laterally by edges 26, 26', on which the glass cover 25 is placed. Both the glass cover 25 and also the edges 26, 26' are made of a transparent or at least milky transparent material.

Figure 4:
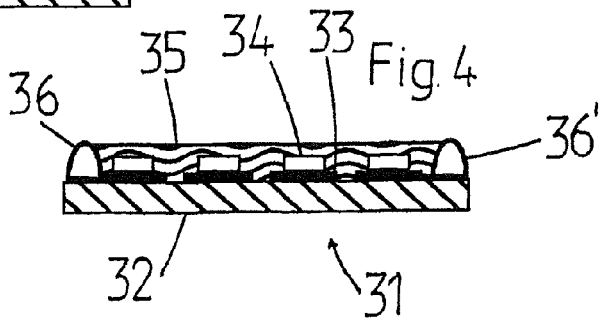
FIG. 4 is a schematic lateral, cross-sectional diagram of another encapsulated chip-on-board LED module according to an embodiment of the invention.

In FIG. 4 a chip-on-board LED module 31 having a substrate 32, strip conductors 33, and LED chips 34 is shown schematically in cross section, in which the LED chips 34 are protected by a potting having a transparent potting material 35. Lateral enclosures 36, 36' are provided in the shape of dams that enclose the potting material 35 in a liquid or gel-like form before the curing. The transparent potting material 35, identified by a wavy pattern, comprises, for example, a silicone, acrylate, or urethane material. The frame or the enclosure 36, 36' can also be transparent, non-transparent, milky transparent, or even opaque.

Both in FIG. 3 and also in FIG. 4, the height of the lateral boundaries is selected so that no significant shadows are produced at the edge. The side walls 26, 26' or the enclosures 36, 36' project only slightly over the surface of the LED chips 24, 34.

Figure 5A:
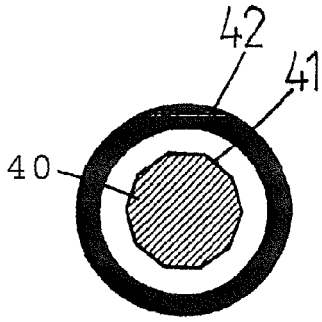
FIGS. 5*a*), *b*) and *c*) are schematic cross-sectional views of different possible geometries of bodies and lighting devices according to embodiments of the invention.

In FIGS. 5*a*) to 5*c*) various possible symmetric geometries of bodies and lighting devices according to the invention are shown schematically in cross section. The lighting device 40 shown in FIG. 5*a*) according to the invention comprises eight chip-on-board LED modules 41 arranged in the form of a regular octagon and is arranged in the interior of a hollow body 42 having a circular cross section. The inner surface of the hollow body 42 is thus illuminated homogeneously.

Figure 5B:
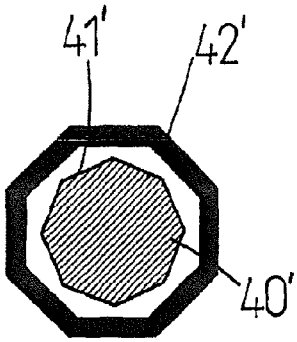

FIG. 5*b*) shows a similarly octagonal lighting device 40' according to the invention having chip-on-board LED modules 41', wherein this lighting device is arranged within a hollow body 42' having a similarly octagonal geometry. Advantageously, the edges of the octagons are displaced relative to each other, such that the sometimes somewhat more weakly illuminating vertexes of the lighting device 41' are set opposite the surface centers of the hollow body 42'. In this way, the other remote vertex areas of the hollow body 42' are also well illuminated.

Figure 5C:
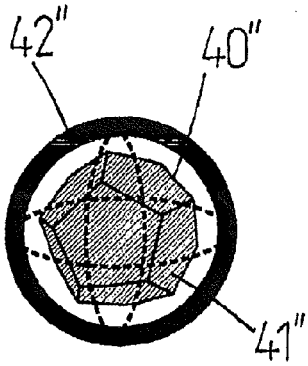

In FIG. 5*c*) an example for a homogeneous illumination of a non-elongated or cylindrical, three-dimensional body 42", having high radial symmetry, by a polyhedral lighting device 40" having chip-on-board LED modules 41" is shown schematically. The body 42" is a hollow sphere. The lighting device 40" is an outwardly radiating dodecahedron having twelve flat, pentagonal surfaces.

Figure 6A:
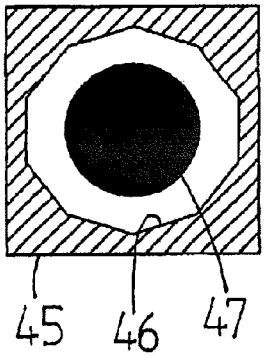
FIGS. 6*a*), *b*) and *c*) are schematic cross-sectional views of various other possible geometries of bodies and lighting devices according to embodiments of the invention.

In FIGS. 6*a*) to 6*c*) situations that are complementary to those of FIGS. 5*a*) to 5*c*) are shown using bodies 47, 47', 47", lighting devices 45, 45', 45", and chip-on-board LED modules 46, 46', 46". Here, in FIGS. 6*a*) to 6*c*) the bodies 47, 47', 47" are irradiated from the outside, and the lighting devices 45, 45', 45" are formed as hollow bodies, whose chip-on-board LED modules 46, 46', 46' radiate into the hollow spaces and irradiate the bodies 47, 47', 47" arranged there.

Figure 7A:
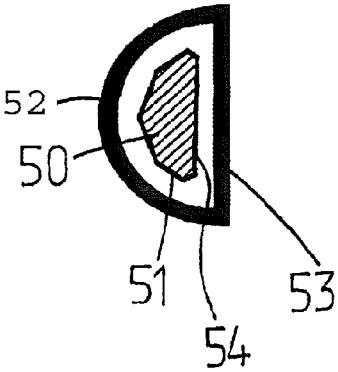
FIGS. 7*a*), *b*) and *c*) are schematic cross-sectional views of various other possible geometries of bodies and lighting devices according to embodiments of the invention.
Figure 7B:
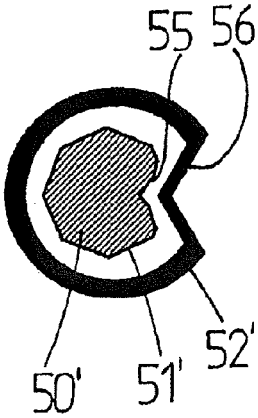
Figure 7C:
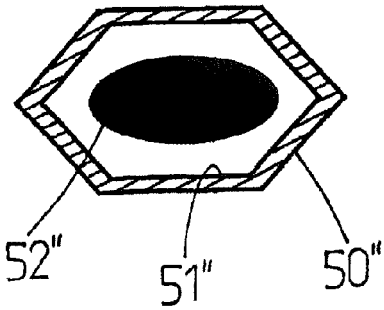

FIGS. 7*a*) to FIG. 7*c*) show, in schematic cross-sectional representations, three examples of non-symmetric geometries of bodies 52, 52', 52" that illuminate or are to be illuminated. These figures illustrate the application of the inventive concept of the geometric adaptation of lighting devices having chip-on-board LED modules for the homogeneous illumination or lighting of bodies for low radial symmetry or non-convex geometry of the bodies.

For example, FIG. 7*a*) shows a half-round pipe 52 having one planar side 53, in which a lighting device 50 according to the invention having chip-on-board LED modules 51 is arranged, of which one is arranged as a flat, illuminating surface 54 opposite the flat side 53 of the half pipe 52.

In FIG. 7*b*) it becomes clear that by adapting the geometry of the lighting device 50' or the arrangement of its chip-on-board LED modules 51' to the shape of the body 52' to be irradiated, a homogeneous illumination of the entire surface to be irradiated is possible. This involves a pipe having a recess 56 that lies opposite a recess 55 in the lighting device 50'.

In FIG. 7*c*) the body 52" is elliptical in cross section. For the lighting device 50" a hexagonal arrangement of the chip-on-board LED modules 51" is selected, which is widened in the direction of the longer axis of the ellipse.

FIG. 8 shows, in cross section, a lighting device 60 according to the invention in detail. Three chip-on-board LED modules 61, 61', 61", each having a substrate 62, strip conductors 63, and LED chips 64, are arranged on a heat sink 65, which has the cross-sectional shape of a half hexagon. The sketch shows the possibility given in COB technology for variation in the spacing of adjacent LED chips 64 on a substrate 63.

Figure 6B:
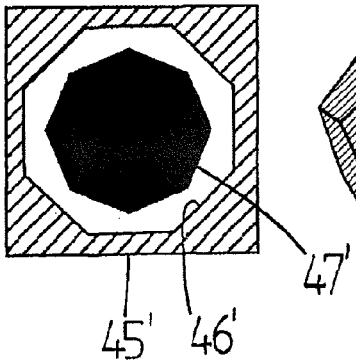
Figure 6C:
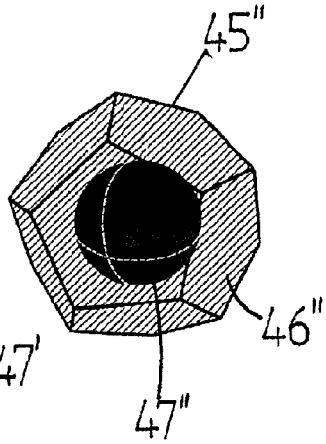

This additional degree of freedom allows further optimization of the homogeneity, in addition to the geometrical adaptation of the lighting device shown in FIGS. 5, 6, and 7. Thus, according to FIG. 8, by a local increase of the chip density, geometry-dependent minimums in the intensity distribution at the abutting edges 66, 66' can be damped or completely avoided at the abutting edges 66, 66'. The reduced overlap of the emission cones visible from FIG. 2 at the joints is compensated, in this case, by a denser placement of the LED chips 64 relative to their greater pitch in the center of a chip-on-board LED module 61, 61', 61".

FIGS. 9*a*) to FIG. 9*d*) show schematically the wiring 73-73'" of LEDs 72 on a chip-on-board LED module 71-71'" that achieves a homogeneous light output. The COB technology allows a flexible selection in the wiring of the LEDs 72 assembled on the substrates. The layout of the strip conductor guide on the substrate defines the wiring 73-73'" of the LEDs 72 and is to be selected in the scope of design specifications of the respective substrate technology with respect to the requirements on the lighting device.

In principle, LEDs 72 can be wired individually and thus controlled individually. However, this is not expedient for a large number of LED chips 72, due to the large number of strip conductors and power supply lines. Instead, LEDs are wired into arrays in combinations of series and parallel circuits. Smaller arrays here offer a higher flexibility in the local tuning of the optical output power and thus possible optimization with respect to an improvement in the homogeneity that can be achieved in the illumination or lighting of a body.

FIG. 9*a*) shows the case in which all of the LEDs 72 of the chip-on-board LED module 71 are powered in series and parallel having the same voltage in a channel "Ch 1". A homogeneous luminosity is produced across the surface of the chip-on-board LED module 71.

FIG. 9*b*) shows a case where the LEDs 72 of the chip-on-board LED modules 71' are divided into four quadrants 74-74'" The luminosity can thus be set differently in each quadrant 74-74'" in four channels "Ch 1" to "Ch 4".

FIG. 9*c*) shows a situation in which individual rows of LEDs 72 on a chip-on-board LED module 71" having four channels "Ch 1" to "Ch 4" are controlled individually. Thus, LED sections or rows at the edges of two adjacent substrates that are tilted relative to each other can be operated with higher currents, in order to counteract a reduced intensity in this edge region.

In FIG. 9*d*) the surface on a chip-on-board LED module 71'" has been divided into two half surfaces 75, 75' that are each operated separately.

Figure 10:
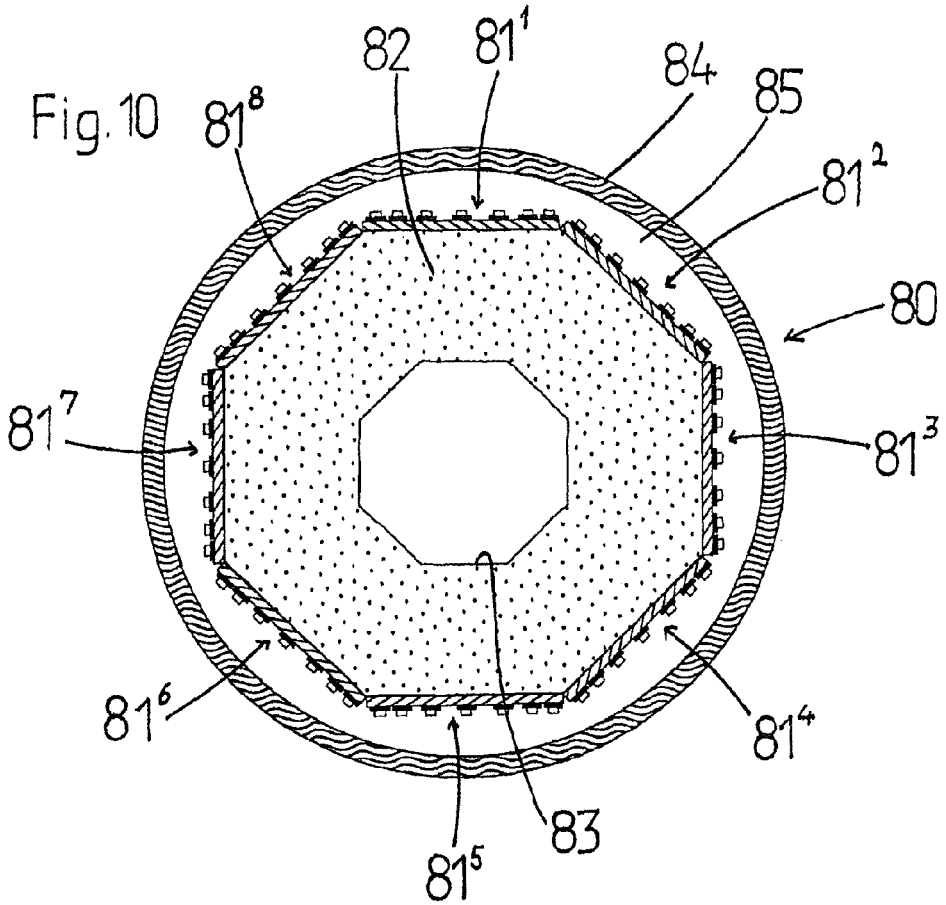
FIG. 10 is a schematic cross-sectional diagram through another lighting device according to an embodiment of the invention.

FIG. 10 shows schematically, in a cross section, a cylindrical lighting device 80 according to the invention having a circular housing 84. The lighting device 80 comprises an octagonal heat sink 82 having a hollow space 83 through which, for example, water flows in a circle in the plane of the figure. On the side surfaces of the heat sink 82 there are chip-on-board LED modules $\mathbf{81}^1$-$\mathbf{81}^8$. The geometric arrangement of modules and the small distance that can be achieved by COB technology between adjacent LED chips of adjacent chip-on-board LED modules $\mathbf{81}^1$-$\mathbf{81}^8$ allows a good overlap of the emission cones of the LEDs and thus a good, homogeneous emission in the peripheral direction already at short distances from the illuminating surface. The light source is surrounded by a cylindrical protective glass 84.

The geometry of the lighting device 80 and also the arrangement of the LEDs on the chip-on-board LED modules $\mathbf{81}^1$-$\mathbf{81}^8$ are adapted to a cylinder-shaped hollow body having an inner wall that can be irradiated homogeneously by the source in its vicinity. Such a light source is needed, e.g. in duct relining.

Figure 11:
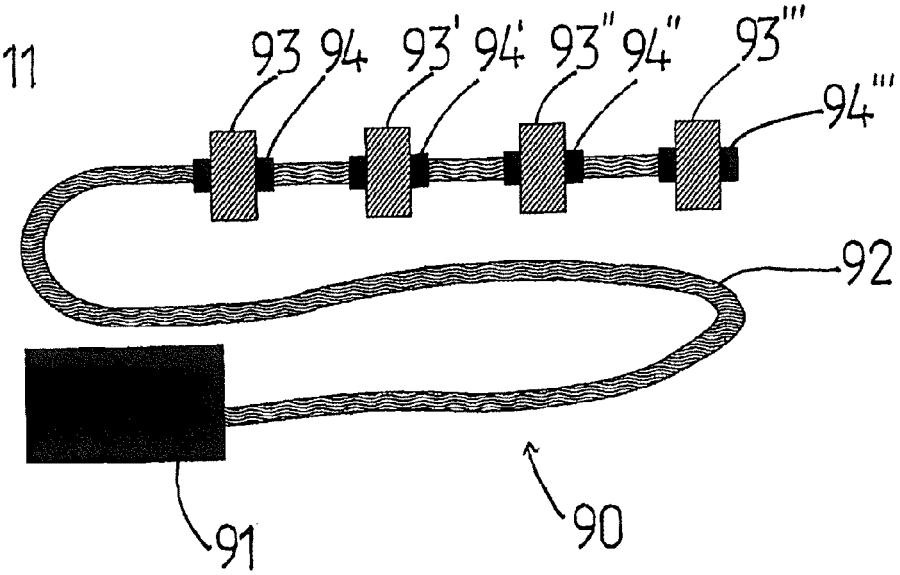
FIG. 11 is a schematic modular diagram of a lighting device according to an embodiment of the invention.

In FIG. 11 a modular configuration of an exemplary lighting unit 90 according to the invention is shown. The lighting unit 90 comprises four cylindrical lighting devices 93-93'" according to the invention having adapted geometries. These can be constructed, for example, like the lighting device 80 in FIG. 10. The lighting devices 93-93'" comprise connection units 94-94'", which are shown as black boxes on the lighting devices 93-93'" and at which power-supply lines 92 are connected to the lighting devices 93-93'".

A lighting device 93-93'" comprises at least one substrate having one or more LEDs placed on a body, which can be a heat sink. The cooling process can be, among other things, convection cooling with gases, liquid cooling, or conduction (line) cooling. The heat sink can be produced, for example, by milling, stamping, cutting, folding, etching, eutectic bonding of metals, etc. The lighting devices can be held in a housing.

Furthermore, sensors for, e.g., temperature, illumination intensity, current intensity, voltage, etc., can be integrated into the lighting unit 90, wherein these sensors report the operating status to a control and power-supply unit 91 and allow the operating conditions to be adapted. The connection units 94-94'" allow a modular expansion with respect to the number of lighting devices 93-93'" as well as the ability to replace the units for maintenance or service purposes. The lighting devices 93-93'" can be coupled by rigid or flexible connection units 94-94'", so that they are either lined up rigidly one next to the other, or they are coupled flexibly by a protective tube, metal springs, or the like, so that the light source can be pulled on a curved path in a pipe. A flexible or rigid power-supply line 92 connects the lighting devices 94-94'" to the control and power-supply unit 91, which can include the electrical power supply and the supply with coolant. This also allows a selective control of relevant operating parameters.

Figure 12:
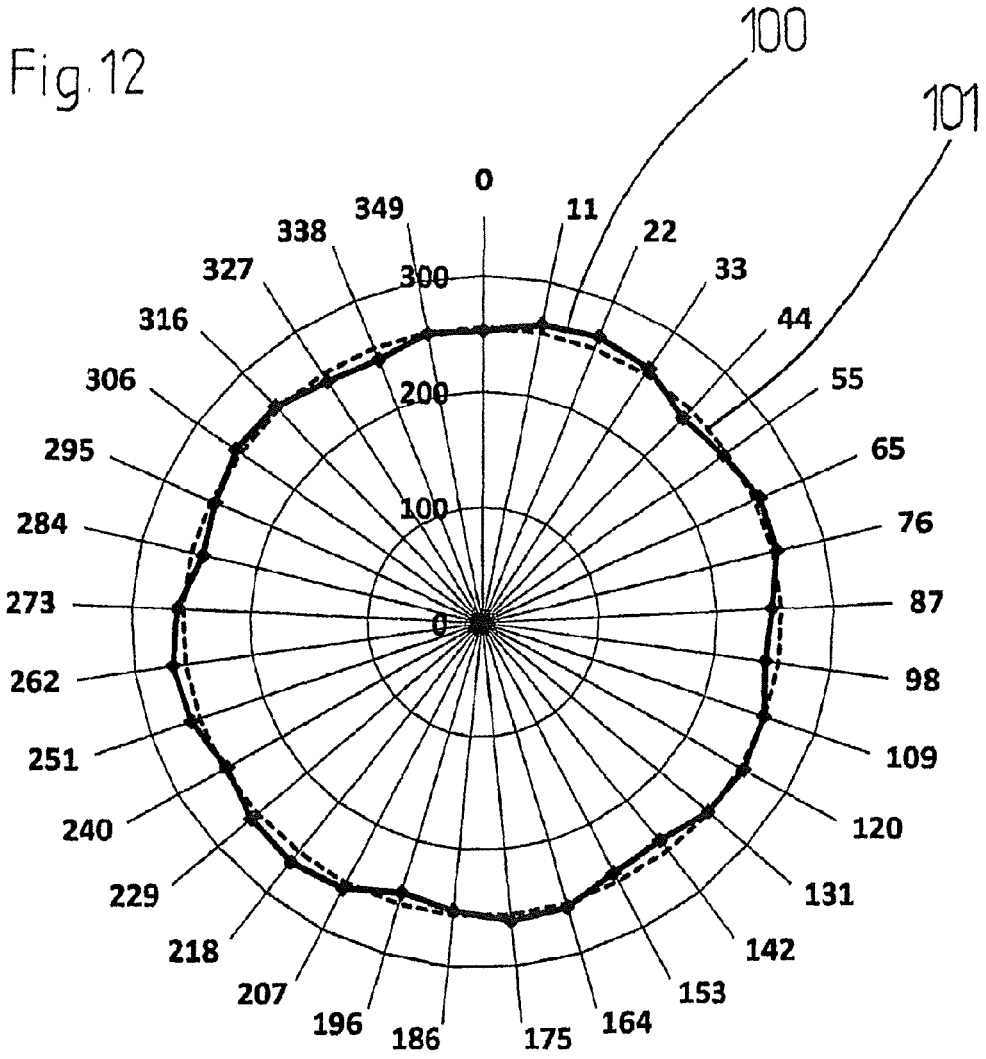
FIG. 12 is a diagram of the homogeneity of the radiation distribution of a lighting device according to an embodiment of the invention.

FIG. 12 shows the measurement result of the emission properties with respect to the power and homogeneity of a lighting device according to the invention. The lighting device involves an elongated lighting device having an octagonal cross section having chip-on-board LED modules arranged at regular intervals in the peripheral direction. The measurement was performed using a pipe having a 14 cm pipe diameter, wherein the distance of the lamp to the inner wall of the pipe was approx. 1.75 cm. Irradiation intensities of up to >1 W/cm$^2$ were achieved. The total number of LED chips on the lighting devices 93-93'" exceeds 300.

The coordinate system in FIG. 12 is a polar coordinate system. The angle running from 0° to 360° describes the circumferential direction of the measurement around the lighting device; the radial coordinates describe the luminosity in arbitrary units. A luminosity 101 averaged across the circumference is shown dashed; the actual measured luminosity values 100 are connected with solid lines. The measurement shows that the homogeneity of the lighting device can be better than +5% in the peripheral direction for a pipe diameter of 14 cm.

All of the mentioned features, even those that are only to be taken from the drawings, as well as also individual features that are disclosed in combination with other features, are to be considered as essential for the invention alone and in combination. Embodiments according to the invention can be fulfilled by individual features or a combination of multiple features.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A lighting device for uniform illumination of curved, uneven, or polyhedral surfaces, the lighting device comprising a plurality of flat chip-on-board LED modules arranged adjacent to each other at least in pairs, wherein in each pair, the chip-on-board LED modules abut each another at a joint, each chip-on-board LED module having a plurality of light-emitting LEDs, and at least one pair of adjacent chip-on-board LED modules being arranged at an angle greater than 0° with respect to the surface normals of the modules, wherein at least one light emitting LED from the at least one pair of adjacent chip-on board LED modules lies in a different plane extending perpendicularly to a longitudinal extent of the light device than at least one other light emitting LED from the at least one pair of adjacent chip-on board LED modules such that the chip-on-board LED modules produce an elongated lighting device having an irregular or regular polygonal cross section at least in some sections along its longitudinal extent.

2. The lighting device according to claim 1, wherein a shape of the lighting device is flexible.

3. The lighting device according to claim 1, wherein the LEDs of the chip-on-board LED modules are arranged pointing outward or into a hollow space of the lighting device.

4. The lighting device according to claim 1, wherein at least two chip-on-board LED modules are connected to a common heat sink connected or connectable to a cooling circuit.

5. The lighting device according to claim 1, wherein a device placement of a chip-on-board LED module having LEDs varies as a function of location.

6. The lighting device according to claim 5, wherein the device placement of the chip-on-board LED module decreases or increases at an edge region of the chip-on-board LED module.

7. The lighting device according to claim 1, wherein the LEDs are arranged on the chip-on-board LED module up to directly on an edge of the chip-on-board LED module.

8. The lighting device according to claim 1, wherein individual LEDs or groups of LEDs of the chip-on-board LED modules are supplied with power separately from each other.

9. The lighting device according to claim 8, wherein groups of LEDs supplied with power separately from each other in the chip-on-board LED modules are arranged in rows, half surfaces, or quadrants of the chip-on-board LED modules.

10. The lighting device according to claim 1, wherein the LEDs of the chip-on-board LED modules are covered at least in some sections by an optically transparent or diffuse material.

11. The lighting device according to claim 10, wherein lateral limits for an overlapping material for a potting material are optically transparent and/or have a height above a surface of the LEDs which does not exceed a spacing between adjacent LEDs.

12. The lighting device according to claim 1, wherein the LEDs of the chip-on-board LED modules are encased at least in some sections in an optically transparent or diffuse material.

13. The lighting device according to claim 12, wherein lateral limits for an enclosure for a potting material are optically transparent and/or have a height above a surface of the LEDs which does not exceed a spacing between adjacent LEDs.

14. The lighting device according to claim 1, wherein the chip-on-board LED modules have at least one imaging and/or non-imaging primary optical element and/or secondary optical element.

15. The lighting device according to claim 14, wherein the at least one optical element is selected from the group of reflectors, lenses, and Fresnel lenses.

16. The lighting device according to claim 1, wherein the chip-on-board LED modules comprise at least one sensor to detect an operating status of the lighting device.

17. The lighting device according to claim 16, wherein the at least one sensor is selected from the group of photosensors, temperature sensors, pressure sensors, motion sensors, voltage sensors, current sensors, and magnetic-field sensors.

18. A lighting unit comprising a control device, a connection line, and at least one lighting device according to claim 1.

19. A method for illumination of hollow bodies that are convex at least in some sections, the method comprising using the lighting device according to claim 1 for drying, hardening, and/or exposure of light-reactive lacquers, adhesives, and resins.

20. The method for illumination of hollow bodies according to claim 19, wherein the lighting device is used for drying, hardening, and/or exposure of light-reactive lacquers, adhesives, and resins in a pipe liner.

* * * * *